US006772900B2

(12) United States Patent
Turner et al.

(10) Patent No.: US 6,772,900 B2
(45) Date of Patent: Aug. 10, 2004

(54) CAN END

(75) Inventors: Timothy Turner, Pecatonica, IL (US); Rajesh Gopalaswamy, Lake Zurich, IL (US); Randy G. Forrest, Park Ridge, IL (US)

(73) Assignee: Rexam Beverage Can Company, Chicago, IL (US)

( * ) Notice: Subject to any disclaimer, the term of this patent is extended or adjusted under 35 U.S.C. 154(b) by 19 days.

(21) Appl. No.: 09/931,497

(22) Filed: Aug. 16, 2001

(65) Prior Publication Data

US 2003/0034346 A1 Feb. 20, 2003

(51) Int. Cl.[7] ..... B65D 17/34

(52) U.S. Cl. ..... 220/269; 220/619; 413/4; 413/11; 413/17

(58) Field of Search ..... 220/269, 619, 220/620, 623, 624; 413/4, 11, 17

(56) References Cited

U.S. PATENT DOCUMENTS

| | | | | |
|---|---|---|---|---|
| 3,186,583 A | | 6/1965 | Zundel | |
| 3,434,623 A | | 3/1969 | Cookson | |
| 3,525,455 A | | 8/1970 | Saunders | |
| 3,705,563 A | | 12/1972 | Elser | |
| 3,765,352 A | | 10/1973 | Schubert et al. | |
| 3,837,524 A | | 9/1974 | Schubert et al. | |
| 3,853,080 A | | 12/1974 | Zundel | |
| 3,868,919 A | | 3/1975 | Schrecker et al. | |
| 3,871,314 A | | 3/1975 | Stargell | |
| 3,941,277 A | | 3/1976 | McKinney et al. | |
| 3,945,334 A | | 3/1976 | Ostrem et al. | |
| 3,990,376 A | | 11/1976 | Schubert et al. | |
| 4,031,837 A | | 6/1977 | Jordan | |
| 4,055,134 A | | 10/1977 | Ostrem et al. | |
| 4,084,721 A | | 4/1978 | Perry, deceased | |
| 4,093,102 A | | 6/1978 | Kraska | |
| 4,116,361 A | | 9/1978 | Stargell | |
| 4,217,843 A | | 8/1980 | Kraska | |
| 4,262,815 A | * | 4/1981 | Klein | 220/269 |
| 4,324,343 A | | 4/1982 | Moller | |
| 4,434,641 A | | 3/1984 | Nguyen | |
| 4,448,322 A | | 5/1984 | Kraska | |
| 4,571,978 A | | 2/1986 | Taube et al. | |

(List continued on next page.)

FOREIGN PATENT DOCUMENTS

| | | |
|---|---|---|
| DE | 2 303 943 | 5/1974 |
| DE | 25 54 264 | 6/1977 |
| DE | 8228681 U | 10/1983 |
| WO | WO 96/37414 | 11/1996 |
| WO | WO 98/34743 | 8/1998 |
| WO | WO 01/41948 | 6/2001 |
| WO | WO 02/00512 | 1/2002 |
| WO | WO02/00512 A | 1/2002 |
| WO | WO02/43895 | 6/2002 |
| WO | WO 02/057137 A2 | 7/2002 |
| WO | WO 02/057148 A1 | 7/2002 |

OTHER PUBLICATIONS

U.S. patent application Ser. No. 09/863,160, Fields, filed Nov. 8, 2001.

U.S. patent application Ser. No. 09/905,310, Ball et al., filed May 2, 2002.

(List continued on next page.)

*Primary Examiner*—Nathan J. Newhouse

(74) *Attorney, Agent, or Firm*—Wallenstein Wagner & Rockey, Ltd.

(57) ABSTRACT

An end member for a container. The end member has a central panel, a circumferential chuckwall, and a transition wall. The central panel is centered about a longitudinal axis and has a substantially planar peripheral edge. The curl defines an outer perimeter of the end member. The circumferential chuckwall extends downwardly from the curl to the transition wall. The transition wall connects the chuck wall with the substantially planar peripheral edge of the central panel. The transition wall has a folded portion extending outwardly relative to the longitudinal axis.

24 Claims, 6 Drawing Sheets

U.S. PATENT DOCUMENTS

| | | | |
|---|---|---|---|
| 4,577,774 | A | 3/1986 | Nguyen |
| 4,641,761 | A | 2/1987 | Smith et al. |
| 4,680,917 | A | 7/1987 | Hableton et al. |
| 4,685,849 | A | 8/1987 | LaBarge et al. |
| 4,704,887 | A | 11/1987 | Bachmann et al. |
| 4,722,215 | A | 2/1988 | Taube et al. |
| 4,804,106 | A | 2/1989 | Saunders |
| 4,832,223 | A | 5/1989 | Kalenak et al. |
| 4,991,735 | A | 2/1991 | Biondich |
| 5,069,355 | A | 12/1991 | Matuszak |
| 5,105,977 | A | 4/1992 | Taniuchi |
| 5,143,504 | A | 9/1992 | Braakman |
| 5,174,706 | A | 12/1992 | Taniuchi |
| 5,823,730 | A | 10/1998 | La Rovere |
| 5,950,858 | A | 9/1999 | Sergeant |
| 6,024,239 | A | 2/2000 | Turner et al. |
| 6,065,634 | A | 5/2000 | Brifcani et al. |
| 6,089,072 | A | 7/2000 | Fields |
| 6,234,337 | B1 | 5/2001 | Huber et al. |
| 6,419,110 | B1 | 7/2002 | Stodd |
| 6,499,622 | B1 | 12/2002 | Neiner |
| 2002/0158071 | A1 | 10/2002 | Chasteen et al. |

OTHER PUBLICATIONS

Great Britain Provisional Specification for "Improvements in or relating to Closured Tins, Jars, or like Containers," Patent No. 422,052, by Robert Barlow, and Arthur Leslie Stuchbery, Complete Specification Accepted: Dec. 31, 1934, Application Date: Jun. 29, 1933.

Australia Complete Specification for "Improvements in the manufacture of tins or sheet metal containers, cans and the like," Patent No. 107,340, by Saml. Hanson & Son, Limited, Accepted: May 3, 1939, Application Date: May 3, 1938.

* cited by examiner

CAN END

TECHNICAL FIELD

The present invention relates to end closures for two-piece beer and beverage metal containers having a non-detachable operating panel. More specifically, the present invention relates to a method of reducing the volume of metal in an end closure.

BACKGROUND OF THE INVENTION

Common easy open end closures for beer and beverage containers have a central panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin sheet of aluminum or steel. End closures for such containers are also typically constructed from a cut-edge of thin sheet of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

One goal of the can end manufacturers is to provide a buckle resistant end. U.S. Pat. No. 3,525,455 (the '455 patent) describes a method aimed at improving the buckle strength of a can end having a seaming curl, a chuckwall, and a countersink along the peripheral edge of a central panel. The method includes forming a fold along at least substantially the entire length of the chuck wall. The fold has a vertical length that is approximately the same length as the seaming curl, and a thickness that is approximately equal to the length of the remaining chuckwall wherein the fold is pressed against the interior sidewall of the container when the end is seamed to the container's open end.

Another goal of the manufacturers of can ends is to reduce the amount of metal in the blank end which is provided to form the can end while at the same time maintaining the strength of the end. One method aimed at achieving this goal is described in U.S. Pat. No. 6,065,634 (the '634 patent). The '634 patent is directed to a can end member having a seaming curl, a chuckwall extending downwardly from the seaming curl to a countersink which is joined to a central panel of the can end. The method of the '634 patent reduces the amount of metal by reducing the cut edge of the blank. This is accomplished by increasing the chuckwall angle from approximately 11–13 degrees to an angle of 43 degrees.

The method of the '634 patent may decrease the diameter of the central panel. This could reduce area on the central panel that is needed for written instructions, such as opening instructions or recycling information. It may also restrict the size of the tear panel. Furthermore, because the angle of the chuckwall is increased, the space between the perimeter of the can end and the tear panel is increased. This could cause spillage during pouring and/or drinking.

The method of the '634 patent also produces a countersink. The '455 patent shares this aspect. The countersink is provided in the can end to improve strength. However, because the countersink is a narrow circumferential recess, dirt will often collect within the countersink. Additionally, the dirt is often difficult to rinse away due to the geometry of the countersink.

SUMMARY OF THE INVENTION

One object of the present invention is to provide an easy open can end member comprising a central panel, a seaming curl, a circumferential chuckwall, and a transition wall. The central panel is centered about a longitudinal axis and has a substantially planar peripheral edge. The seaming curl defines an outer perimeter of the end member. The chuckwall extends downwardly from the seaming curl. The transition wall connects the chuckwall with the substantially planar peripheral edge of the central panel. The transition wall comprises a folded portion extending outwardly relative to the longitudinal axis.

Another object of the present invention is to provide an easy open can end member comprising a central panel, a seaming curl, a circumferential chuckwall, and a transition wall. The central panel is centered about a longitudinal axis and has a substantially planar peripheral edge, a public side and a product side. The seaming curl defines an outer perimeter of the end member. The chuckwall extends downwardly from the seaming curl. The transition wall connects the chuckwall with the peripheral edge of the central panel and comprises a fold including a concave annular portion engaging the peripheral edge of the central panel.

Another object of the present invention is to provide an easy open can end member comprising a central panel, a seaming curl, a circumferential chuckwall, and a transition wall. The central panel is centered about a longitudinal axis. The seaming curl defines an outer perimeter of the end member. The circumferential chuckwall extends downwardly from the seaming curl at an obtuse angle. The transition wall connects the chuckwall with the central panel, and the transition wall comprises a fold having a portion extending outwardly relative to the longitudinal axis and upwardly relative to the central panel wherein the fold has a thickness which is substantially less than a length of the chuckwall.

Another object of the present invention is to provide an easy open can end member comprising a central panel, a seaming curl, a circumferential chuckwall, and a transition wall. The central panel is centered about a longitudinal axis and has a peripheral edge. The seaming curl defines an outer perimeter of the end member and is adapted for connecting the end member to a container body. The chuckwall extends downwardly from the seaming curl. The transition wall connects the chuckwall with the peripheral edge of the central panel, and comprises a fold extending outwardly relative to the longitudinal axis and upwardly relative to the central panel. The transition wall has a vertical length that is less than a length of the seaming curl.

Another object of the present invention is to provide an easy open can end member comprising a central panel, a seaming curl, a circumferential chuckwall, and a transition wall. The central panel is centered about a longitudinal axis and has a peripheral edge, a public side and a product side. The seaming curl defines an outer perimeter of the end member. The chuckwall extends downwardly from the seaming curl. The transition wall connects the chuckwall with the peripheral edge of the central panel. The transition wall comprises a fold including a concave annular portion having an apex in engagement with the public side of the peripheral edge of the central panel.

Another object of the present invention is to provide an easy open can end member comprising a central panel, a seaming curl, a circumferential chuckwall, and a transition wall. The central panel is centered about a longitudinal axis and has a substantially planar peripheral edge, a public side and a product side. The seaming curl defines an outer perimeter of the end member. The chuckwall extends downwardly from the seaming curl. The transition wall connects the chuckwall with the peripheral edge of the central panel. The transition wall comprises a fold including a first leg extending downwardly from the chuckwall to a concave annular portion having a first apex in engagement with the public side of the peripheral edge of the central panel, a second leg extending upwardly from the convex annular portion to a convex annular portion, and a third leg extending downwardly from the convex annular portion to a radial bend portion joined to the peripheral edge of the central panel.

Another object of the present invention is to provide a method for forming an easy open can end member comprising a central panel, a seaming curl, a circumferential chuckwall, and a transition wall. The method includes the step of providing a can end shell including a central panel centered about a longitudinal axis having a peripheral edge, a public side and a product side, a seaming curl defining an outer perimeter of the can end shell, and a circumferential chuckwall extending downwardly from the seaming curl joined to a transition wall. The method also includes the step of reforming the transition wall to form a fold having a portion extending outwardly relative to the longitudinal axis.

Other features and advantages of the invention will be apparent from the following specification taken in conjunction with the following drawings.

DETAILED DESCRIPTION

Figure 1:
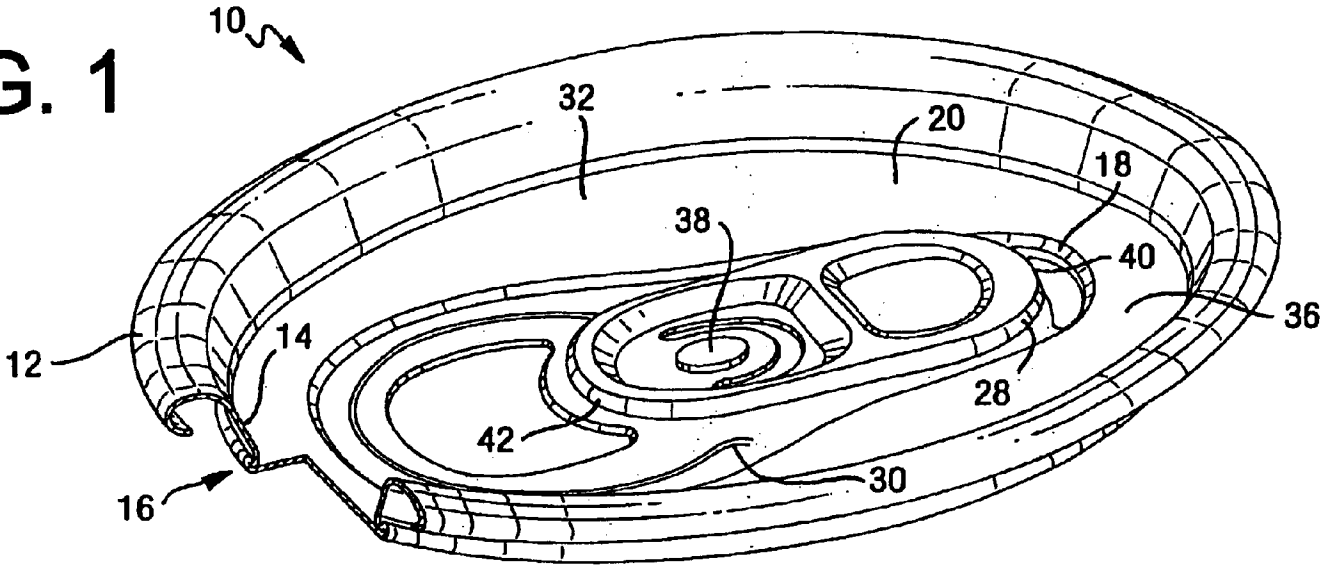
FIG. 1 is a perspective view of a can end of the present invention having a cutaway view of a portion of the perimeter.

While this invention is susceptible of embodiment in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

The container end of the present invention is a stay-on-tab end member 10 with improved physical properties including strength. Essentially, the present invention provides a lightweight end member 10 which embodies the physical characteristics and properties required in the beverage container market, as explained below.

Referring to FIG. 1, the end member 10 for a container (not shown) has a seaming curl 12, a chuckwall 14, a transition wall 16, and central panel wall 18. The container is typically a drawn and ironed metal can such as the common beer and beverage containers, usually constructed from a thin sheet of aluminum or steel that is delivered from a large roll called coil stock of roll stock. End closures for such containers are also typically constructed from a cut edge of thin sheet of aluminum or steel delivered from coil stock, formed into blank end, and manufactured into a finished end by a process often referred to as end conversion. In the embodiment shown in the Figures, the end member 10 is joined to a container by a seaming curl 12 which is joined to a mating curl of the container. The seaming curl 12 of the end closure 10 is integral with the chuckwall 14 which is joined to an outer peripheral edge portion 20 of the central panel 18 by the transition wall 16. This type of means for joining the end member 10 to a container is presently the typical means for joining used in the industry, and the structure described above is formed in the process of forming the blank end from a cut edge of metal sheet, prior to the end conversion process. However, other means for joining the end member 10 to a container may be employed with the present invention.

The central panel 18 has a displaceable tear panel 22 defined by a curvilinear frangible score 24 and a non-frangible hinge segment 26. The hinge segment 26 is defined by a generally straight line between a first end 28 and a second end 30 of the frangible score 24. The tear panel 22 of the central panel 18 may be opened, that is the frangible score 24 may be severed and the tear panel 22 displaced at an angular orientation relative to the remaining portion of the central panel 18, while the tear panel 22 remains hingedly connected to the central panel 18 through the hinge segment 26. In this opening operation, the tear panel 22 is displaced at an angular deflection, as it is opened by being displaced away from the plane of the panel 18.

The frangible score 24 is preferably a generally V-shaped groove formed into the public side 32 of the central panel 18. A residual is formed between the V-shaped groove and the product side 34 of the end member 10.

The end member 10 has a tab 36 secured to the central panel 18 adjacent the tear panel 22 by a rivet 38. The rivet 38 is formed in the typical manner.

During opening of the end member 10 by the user, the user lifts a lift end 40 of the tab 36 to displace a nose portion 42 downward against the tear panel 22. The force of the nose portion 42 against the tear panel 22 causes the score 24 to fracture. As the tab 36 displacement is continued, the fracture of the score 24 propagates around the tear panel 22, preferably in progression from the first end 28 of the score 24 toward the second end 30 of the score 24.

Figure 2:
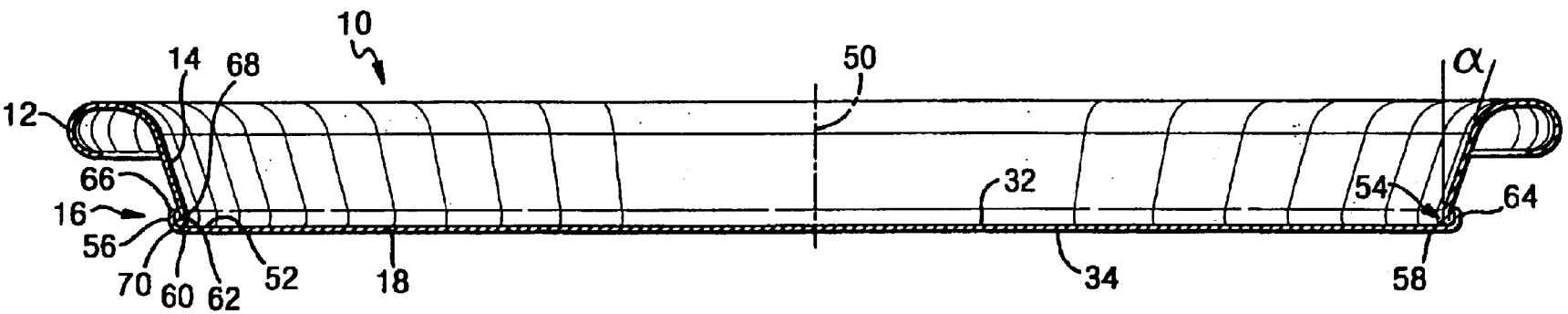
FIG. 2 is a partial cross-sectional view of a can end member of the present invention.

Now referring to FIG. 2, the central panel 18 is centered about a longitudinal axis 50. The seaming curl 12 defines an outer perimeter of the end member 10 and is integral with the chuckwall 14. The chuckwall 14 extends downwardly from the seaming curl 12 at an obtuse angle. A chuckwall angle a measured from a planar or substantially planar peripheral edge portion 52 of the central panel 18 is generally between 10 and 70 degrees, more preferably between 15 and 45 degrees, and most preferably 19 to 27 degrees, or any range or combination of ranges therein. The chuckwall 14 may be provided with a radius of curvature as shown in the drawings to improve performance within the forming tools used to form the end member 10. The radius of curvature helps prevent buckling within the tools as force is applied to the unfinished end member 10.

The transition wall 16 is integral with the chuckwall 14 and connects the chuckwall 14 the to the peripheral edge portion 52 of the central panel 18. The end member 10 differs from contemporary beverage can end members that typically include a countersink formed in the outer peripheral edge of the central panel. The planar peripheral edge portion 52 allows the tear panel 24 to be place closer to the outer perimeter of the end member 10. It also provides additional central panel 18 area for printing and/or a larger tear panel opening.

The transition wall 16 includes a fold 54 extending outwardly relative to the longitudinal axis 50. The drawings show the fold 54 formed along an exterior portion of the chuckwall 14; however, it should be understood that the fold 54 transition wall 16 can be located in other locations such as along the product side 34 of the central panel 18.

The fold 54 has a first leg 56 connecting the chuckwall 14 to an annular concave bend or portion 58. The annular concave portion 58 includes and apex 60 which engages the outer peripheral edge 52 of the central panel 18. This contact between the apex 60 and the outer peripheral edge 52 helps to prevent dirt from accumulating along the peripheral edge 52 of the central panel 18. It also allows the central panel 18 to be easily cleaned when dirt or other residue is present on the central panel 18.

A second leg 62 extends upwardly from the annular concave portion 58 to an annular convex bend or portion 64. The second leg 62 can be vertical, substantially vertical, or up to ±25 degrees to the longitudinal axis 50 and can be pressed against an outer portion of the first leg 56.

The annular convex portion 64 includes an apex 66 which defines a vertical extent of the fold 54. A length of the fold 54 is substantially less than a length of the seaming curl 12. In combination with, inter alia, the angled chuckwall 14, this fold 54 structure and length allows the buckling strength of the end member 10 to be meet customer requirements while decreasing the size of the cut edge blank and maintaining the diameter of the finished end. In other words, a smaller cut edge blank can be provided to produce the same sized diameter end member as a larger cut edge blank formed in the conventional manner with a countersink.

A third leg 68 extends downwardly from the annular convex portion 64 to a third bend 70 which joins the transition wall 16 to the outer peripheral edge 52 of the central panel 18. The third bend 70 has a radius of curvature which is suitable for connecting the third leg 68 to the planar outer peripheral edge of the central panel 18.

The third leg 68 can be pressed against an outer portion of the second leg 62. This gives the fold 54 a transverse thickness which is substantially equal to three times the thickness of the thickness of the chuckwall 14, and is the transverse thickness of the fold 54 is substantially less than the length of the chuckwall 14. Again, this structure results in a metal savings by allowing the cut edge blank to be smaller than conventional cut edge blanks used to make the same diameter end member. For example, the average diameter of a cut edge blank used to form a standard 202 can end is approximately 2.84 inches while the average diameter of a cut edge blank used to form a 202 can end of the present invention is approximately 2.70 inches.

FIGS. 3–8 and FIGS. 9–13, illustrate one method for forming an end member 10 of the present invention. FIGS. 3–8 show the progression of the end member 10 from a shell to the finished end 10 without the tooling. FIGS. 9–13 show the tooling contemplated for forming the end member 10. The method shows the fold 54 formed from a lower segment of the chuckwall 14 called referred to as the transition wall 16 herein. However, it should be understood that the transition wall 16 can be formed from a portion of the peripheral edge 52 of the central panel 18 without departing from the spirit of the invention.

Figure 3:
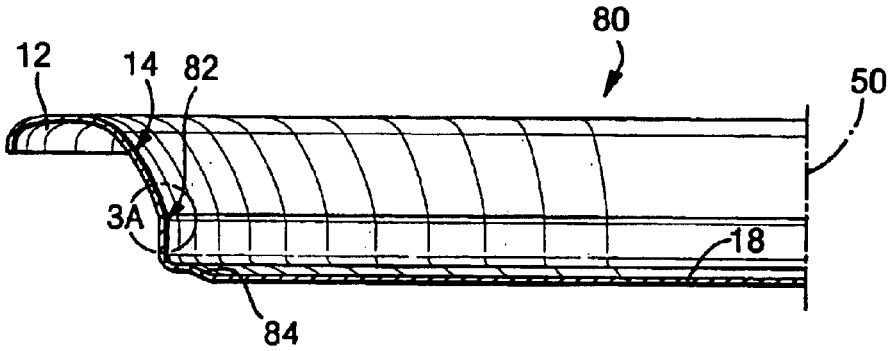
FIGS. 3–8 are partial cross-sectional views of a can end member of the present invention shown in forming stages.
Figure 3A:
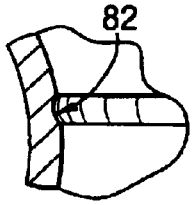
Figure 4:
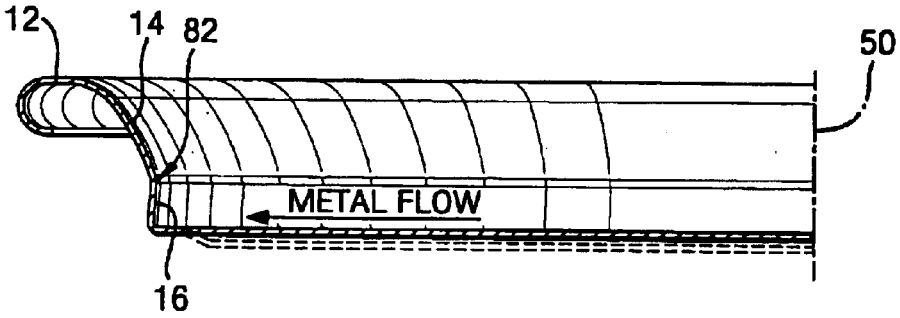
Figure 5:
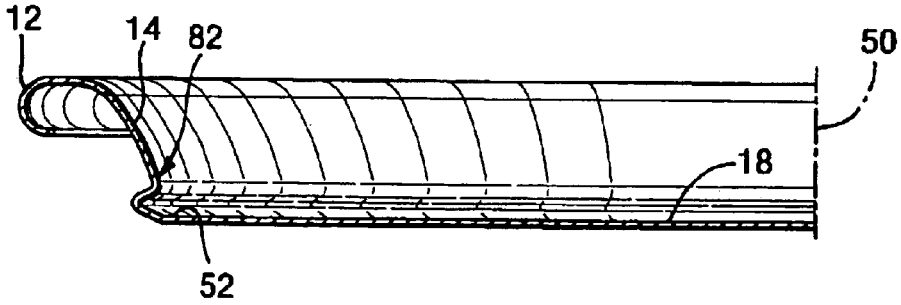
Figure 9:
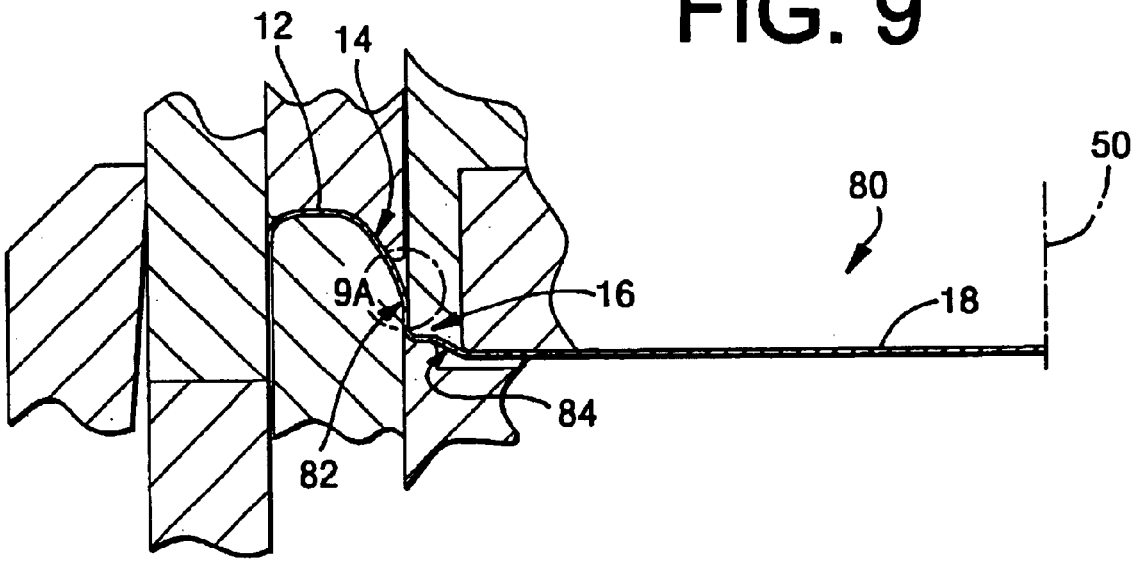
FIGS. 9–13 are partial cross-sectional views of a can end member and tooling of the present invention shown in forming stages.
Figure 9A:
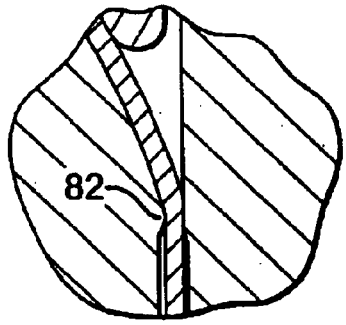
Figure 10:
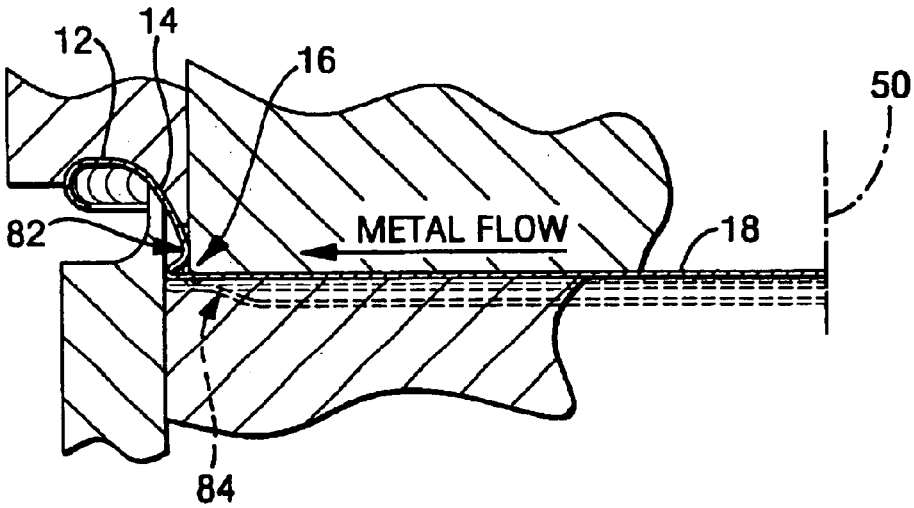

Referring to FIGS. 3 and 9, the method includes the step of providing an end shell 80. The end shell 80 includes a hinge point 82 formed at the junction between the chuckwall 14 and the transition wall 16. In FIG. 4, the hinge point 82 is a coined portion on an interior of the end shell 80. In FIG. 9, the hinge point 82 is a coin on the exterior of the end shell 80. The hinge point 82 may also be provided along the peripheral edge 52 of central panel 18. The hinge point 82 is provided to initiate bending at a predetermined point along the chuckwall 14/transition wall 16. In this example, the hinge point 82 defines the boundary between the chuckwall 14 and the transition wall 16.

The end shell 80 also includes an angled portion 84 along the peripheral edge 52 of the central panel 18. This angled portion is formed to promote stacking of the end shells 80 as they are transported from a shell press to a conversion press. The angled portion 84 also promotes metal flow outwardly relative to the longitudinal axis 50 to promote formation of the fold 54 in the conversion press.

FIGS. 4–8 and 10–13 show a process of converting the end shell 80 to the finished end member 10 in a four stage operation carried out in a conversion press. In the first stage (FIGS. 4, 5 and 10), relative movement between the tooling members causes an outward bulge (the beginning of the annular convex portion 64) to form in the transition wall 16. The bending of the transition wall 16 is initiated at the hinge point 82 (the beginning of the annular concave portion 58). At the same time, the angled portion 84 of the peripheral edge 52 is flattened to form the peripheral edge 52 into a planar structure. The relative movement of the tooling also causes the hinge point 82 to move towards the flattened peripheral edge 52 of the central panel 18.

Figure 6:
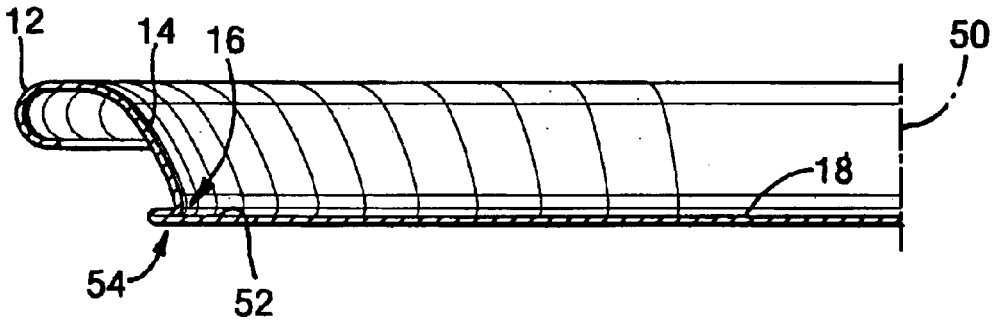
Figure 11:
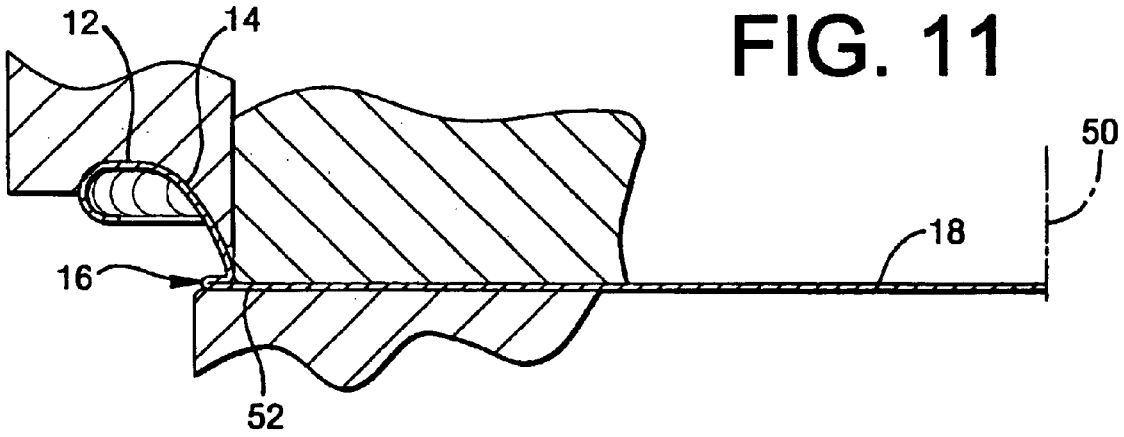

FIGS. 6 and 11 illustrate the second stage of the conversion press. In the second stage, relative movement by the tooling forces the hinge point 82 towards the peripheral edge portion 52. The annular convex portion 64 is fully formed and extends outwardly substantially perpendicular to the longitudinal axis 50. A portion of the hinge point 82 is engaging or very nearly engaging the peripheral edge 52 of the central panel 18.

Figure 7:
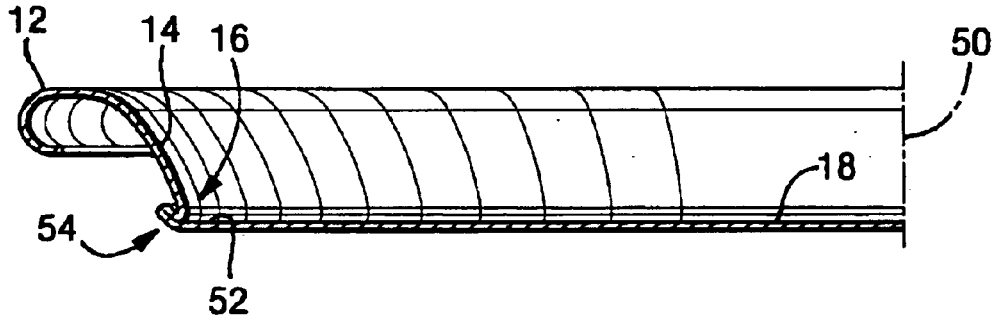
Figure 12:
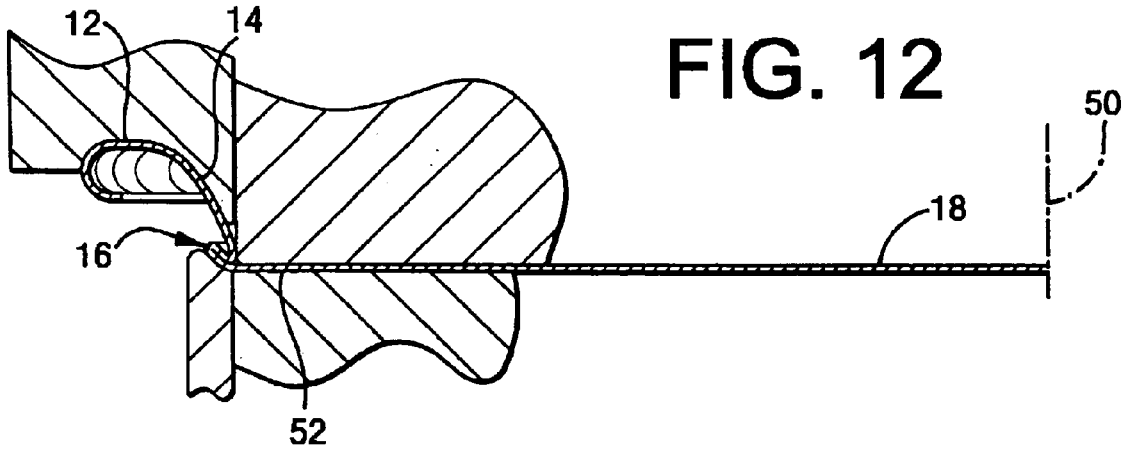

FIGS. 7 and 12 illustrate the third stage of the conversion press. In the third stage, relative movement by the tooling forces the fold 54 upwardly relative to the central panel 18. This forms the third bend 70 and shortens a radius of curvature of the annular concave portion 58.

Figure 8:
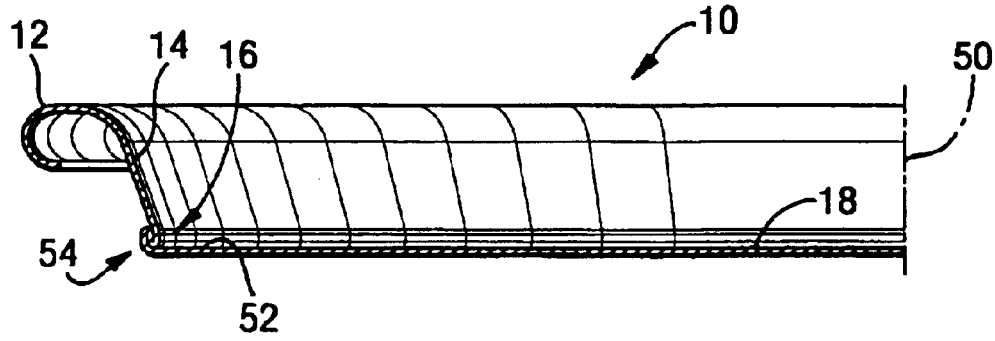
Figure 13:
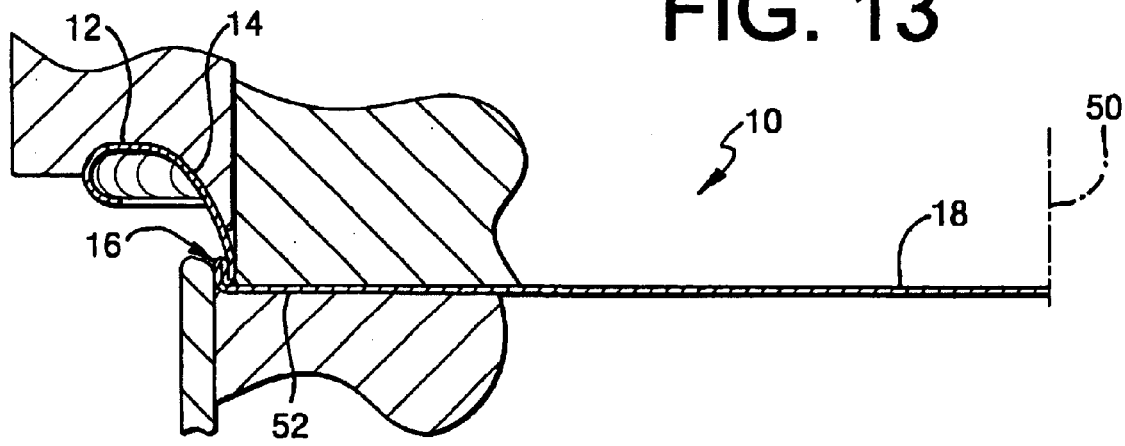

FIGS. 8 and 13 illustrate the fourth stage of the conversion press. In the fourth stage, relative movement by the tooling forces the fold 54 farther upwardly relative to the central panel 18 until the fold 54 is substantially vertical, parallel with the longitudinal axis 50. The annular concave portion 58 is fully formed and is in engagement or very nearly in engagement with the peripheral edge portion 52.

Figure 14:
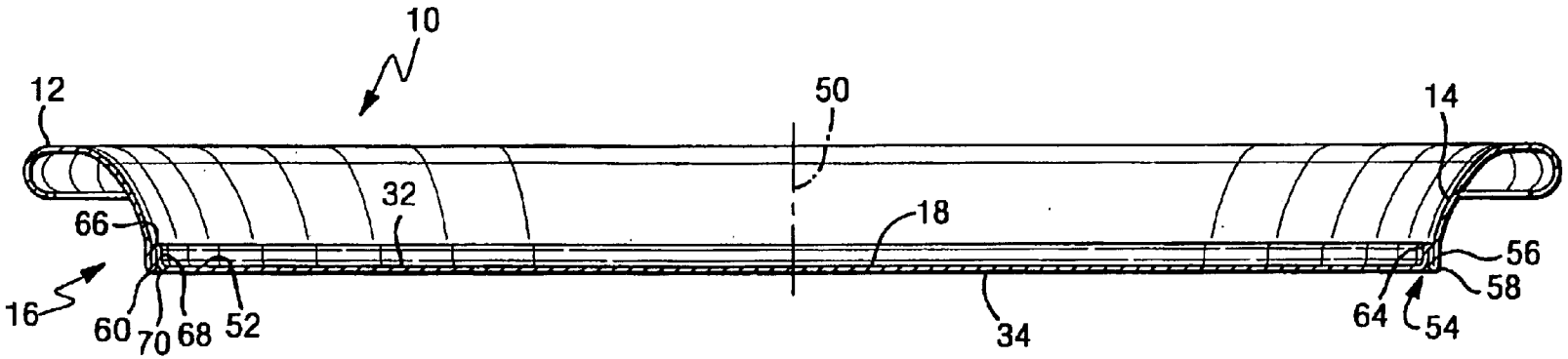
FIG. 14 is a partial cross-sectional view of a can end of the present invention.

FIG. 14 illustrates an alternative embodiment of the can end 10 of the present invention. In this embodiment, the fold 54 extends inwardly relative to the longitudinal axis 50. The annular concave portion 58 does not contact the peripheral edge 52.

Figure 15:
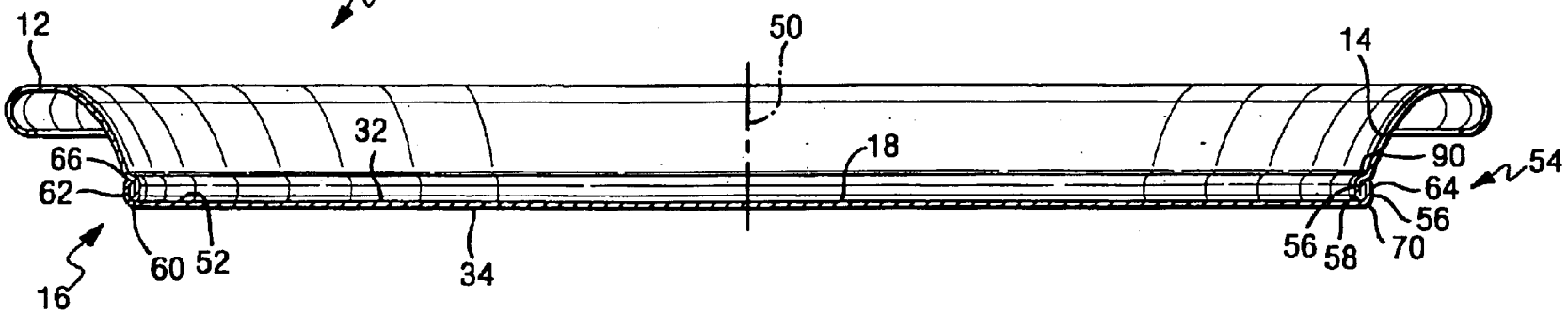
FIG. 15 is a partial cross-sectional view of a can end of the present invention.

FIG. 15 illustrates yet another embodiment of the can end 10 of the present invention. In this embodiment, the chuckwall 14 includes an outwardly extending step 90 for increased strength. The step 90 bends outwardly against the annular convex portion 64. In this embodiment, the outer portion of the step engages vertical extent of the annular convex portion 64.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. An easy open can end member comprising:

a central panel centered about a longitudinal axis having a peripheral edge and a tear panel defined by fracturable score, the tear panel retained to the central panel along a non-scored hinge region;

a curl defining an outer perimeter of the end member;

a circumferential chuckwall extending downwardly from the curl; and a transition wall connecting the chuckwall with the peripheral edge of the central panel, the transition wall comprising a folded portion having a first end portion directly connected to the chuckwall and a second end portion connected to the central panel, the folded portion comprising an annular concave bend extending downwardly from the chuckwall, an annular convex bend extending upwardly from the annular concave bend, and a third bend joining the annular convex bend with the central panel wherein the third bend has a radius of curvature substantially defined by a lower extent of the annular concave bend.

2. The easy open can end member of claim 1 wherein the folded portion extends outwardly relative to the longitudinal axis.

3. The easy open can member of claim 2 wherein the folded portion further extends upwardly relative to the central panel.

4. The easy open can member of claim 1 wherein the second end portion is directly connected to the peripheral edge of the central panel.

5. The easy open can member of claim 1 wherein the chuckwall extends downwardly from the curl at an obtuse angle and the folded portion has a thickness that is substantially less than a length of the chuckwall.

6. The easy open can end member of claim 1 wherein the annular concave bend includes an apex, the apex being in engagement with the peripheral edge of the central panel.

7. An easy open can end member comprising:

a central panel centered about a longitudinal axis having a peripheral edge;

a curl defining an outer perimeter of the end member;

a circumferential chuckwall extending downwardly from the curl; and a transition wall connecting the chuckwall with the peripheral edge of the central panel, the transition wall comprising a folded portion extending upwardly along the chuckwall, the folded portion comprising an annular concave bend extending downwardly from the chuckwall, an annular convex bend extending upwardly from the annular concave bend, and a third bend joining the annular convex bend with the central panel wherein the third bend has a radius of curyature substantially defined by a lower extent of the annular concave bend wherein the concave annular portion includes an apex in engagement with the peripheral edge of the central panel.

8. The easy open can member of claim 7 wherein the folded portion extends outwardly relative to the longitudinal axis.

9. The easy open can member of claim 8 wherein the fold has a length less than a length of the curl.

10. The easy open can member of claim 7 wherein the chuckwall extends downwardly from the curl at an obtuse angle and the folded portion has a thickness that is substantially less than a length of the chuckwall.

11. An easy open can end member comprising:

a central panel centered about a longitudinal axis having a peripheral edge, a public side and a product side;

a curl defining an outer perimeter of the end member;

a circumferential chuckwall extending downwardly from the curl; and a transition wall connecting the chuckwall with the peripheral edge of the central panel, the transition wall comprising a fold including a concave annular portion having an apex engaging the peripheral edge of the central panel.

12. The easy open can end member of claim 11 wherein the apex engages the public side of the peripheral edge of the central panel.

13. The easy open can end member of claim 11 wherein the fold further includes a convex annular portion joined to the concave annular portion and interconnected to the peripheral edge of the central panel.

14. The easy open can end member of claim 13 wherein the fold further includes a third bend joining the convex annular portion to the peripheral edge of the central panel.

15. The easy open can end member of claim 14 wherein the fold has a thickness less than a length of the chuckwall.

16. The easy open can end member of claim 11 wherein the fold includes a portion extending outwardly relative to the longitudinal axis.

17. The easy open can end member of claim 16 wherein the portion of the fold further extends upwardly relative to the central panel.

18. An easy open can end member comprising:

a central panel centered about a longitudinal axis having a substantially planar peripheral edge, a public side and a product side;

a curl defining an outer perimeter of the end member;

a circumferential chuckwall extending downwardly from the curl; and a transition wall connecting the chuckwall with the peripheral edge of the central panel, the transition wall comprising a fold including a first leg extending downwardly from the chuckwall to a concave annular portion having a first apex in engagement with the public side of the peripheral edge of the central panel, a second leg extending upwardly from the convex annular portion to a convex annular portion, and a third leg extending downwardly from the convex annular portion to a radial bend portion joined to the peripheral edge of the central panel.

19. A method for forming an easy open can end member, the method comprising the steps of:

providing a can end shell including a central panel centered about a longitudinal axis having a peripheral edge, a public side and a product side, a curl defining an outer perimeter of the can end shell, and a circumferential chuckwall extending downwardly from the curl joined to a transition wall;

coining a hinge point between the chuckwall and the transition wall; and reforming the transition wall to form a fold having a first end portion directly connected to the chuckwall and a second end portion connected to the central panel wherein the fold is initiated at the hinge point.

20. The method of claim 19 further comprising the step of reforming the central panel to form a substantially planar peripheral edge.

21. The method of claim 19 further comprising the step of providing relative movement between the central panel and the hinge point wherein the hinge point moves towards the peripheral edge of the central panel and the second end portion of the fold moves outwardly relative to the longitudinal axis.

22. The method of claim 21 further comprising the step of providing relative movement between the second end portion of the fold and the central panel wherein the second end portion of the fold extends upwardly relative to the central panel.

23. The method of claim 22 further comprising the step of continuing providing relative movement between the second end portion of the fold and the central panel until the second end portion of the fold is substantially perpendicular to the central panel.

24. The method of claim 22 further comprising the step of continuing providing relative movement between the second end portion of the fold and the central panel until the hinge point engages the peripheral edge of central panel.

* * * * *

UNITED STATES PATENT AND TRADEMARK OFFICE

CERTIFICATE OF CORRECTION

PATENT NO. : 6,772,900 B2
DATED : August 10, 2004
INVENTOR(S) : Turner et al.

It is certified that error appears in the above-identified patent and that said Letters Patent is hereby corrected as shown below:

Column 1,
Line 49, delete “chuck wall” and isnert -- chuckwall --.

Column 5,
Line 1, delete “a” and insert -- α --.

Column 8,
Line 7, delete “curyature” and insert -- curvature --.

Signed and Sealed this

Ninth Day of August, 2005

JON W. DUDAS
*Director of the United States Patent and Trademark Office*